United States Patent [19]

Pizzo

[11] 4,127,909

[45] Dec. 5, 1978

[54] INFLATABLE RAFT CONSTRUCTION AND METHOD

[75] Inventor: Frank Pizzo, South San Francisco, Calif.

[73] Assignee: C. J. Hendry Company, San Francisco, Calif.

[21] Appl. No.: 726,842

[22] Filed: Sep. 27, 1976

[51] Int. Cl.[2] ..... B63C 9/04

[52] U.S. Cl. ..... 9/11 A; 9/2 A; 156/227; 156/309

[58] Field of Search ..... 9/2 A, 11 A, 13; 138/89.1, 93, 120; 285/197, 260; 156/227, 309; 46/87; 52/2

[56] References Cited

U.S. PATENT DOCUMENTS

| | | | |
|---|---|---|---|
| 1,884,705 | 10/1932 | Huffman | 9/2 A X |
| 2,369,736 | 2/1945 | Hurt | 9/13 X |
| 3,037,218 | 6/1962 | Brooks | 9/11 A |
| 3,072,930 | 1/1963 | Fraebel | 9/11 A |
| 3,995,339 | 12/1976 | Kaufman | 9/2 A |

*Primary Examiner*—Trygve M. Blix
*Assistant Examiner*—Sherman D. Basinger
*Attorney, Agent, or Firm*—Flehr, Hohbach, Test, Albritton & Herbert

[57] ABSTRACT

A construction for inflatable rafts and the like wherein two inflatable tubes are joined together approximately at right angles, the end of the first tube being joined to the side of the second tube. Both tubes are maintained integral in themselves except for small pierced openings to permit the passage of inflating gas between them. The method of fabricating the construction includes partially forming a first tube from a flat strip of fabric and providing a folded length of seam tape, the outer surfaces of which are joined to the inside of the first formed tube at the end margin thereof. The folded seam tape thus seals the end of the first tube. The sealed end of the first tube is then cemented to a length of fabric which will form the second tube. The area of cementing the two tubes is over a portion of the second tube which is the normal area of incidence of the two tubes as they intersect. With the flattened first tube laid over the fabric of the second tube one side of the first tube is cemented to half of the area of incidence following which the length of fabric to form the second tube is folded over the end of the first tube and the other side of the first tube is cemented to the remainder of the area of incidence. While still in this position vent ports are punched into the two tubes so as to permit subsequent passage of inflating gases.

6 Claims, 9 Drawing Figures

INFLATABLE RAFT CONSTRUCTION AND METHOD

BACKGROUND OF THE INVENTION

Inflatable life raft construction in the past has frequently employed the use of several tubes joined together and particularly of the end of one tube, such as an arch tube, being joined to the side of a second tube, such as a buoyancy tube. In the past such construction has been accomplished by cutting a sufficiently large opening in the buoyancy tube to permit passage of the end of the arch tube therethrough. The end of the arch tube is pre-cut longitudinally to form a series of axially directed fingers which are folded back radially inside the buoyancy tube and glued along the periphery of the large opening. The junction is sealed by use of seam tapes. Not only does such a manner of construction provide a relatively leak prone seam but it is also extremely tedious to form. Moreover, due to the large opening in the buoyancy tube the junction is an extremely weak area in the overall construction.

SUMMARY OF THE INVENTION AND OBJECTS

In accordance with the invention both the first and second tubes which may be an arch tube and a buoyancy tube, respectively are joined together as complete tubes each being totally integral. The only opening at the junction of the two tubes includes a pair of small vent openings which do not structurally weaken the construction to any serious extent. The sealed end of the arch tube is abutted against the side of the buoyancy tube and cemented thereto over the complete area of their intersection rather than merely at the periphery of their intersection as in the prior art.

The actual construction is begun with both tubes still in the form of a flat sheet of fabric. When completed one tube is only partially formed and the other is still in the form of a flat sheet of fabric. First, a length of seam tape is folded to form a hinge. One outside surface of the hinge is secured to one-half of the end margin of the arch tube fabric. The arch tube fabric is then folded longitudinally and the tube is partially formed by cementing the longitudinal edges together at said end. The remainder of the end margin is then cemented to the other outside surface of the hinge. The hinged end of the arch tube is then cemented to the face of the buoyancy tube one side at a time after which vent holes are punched in the tubes where they are cemented together.

DETAILED DESCRIPTION OF THE PREFERRED EMBODIMENT

Figure 1:
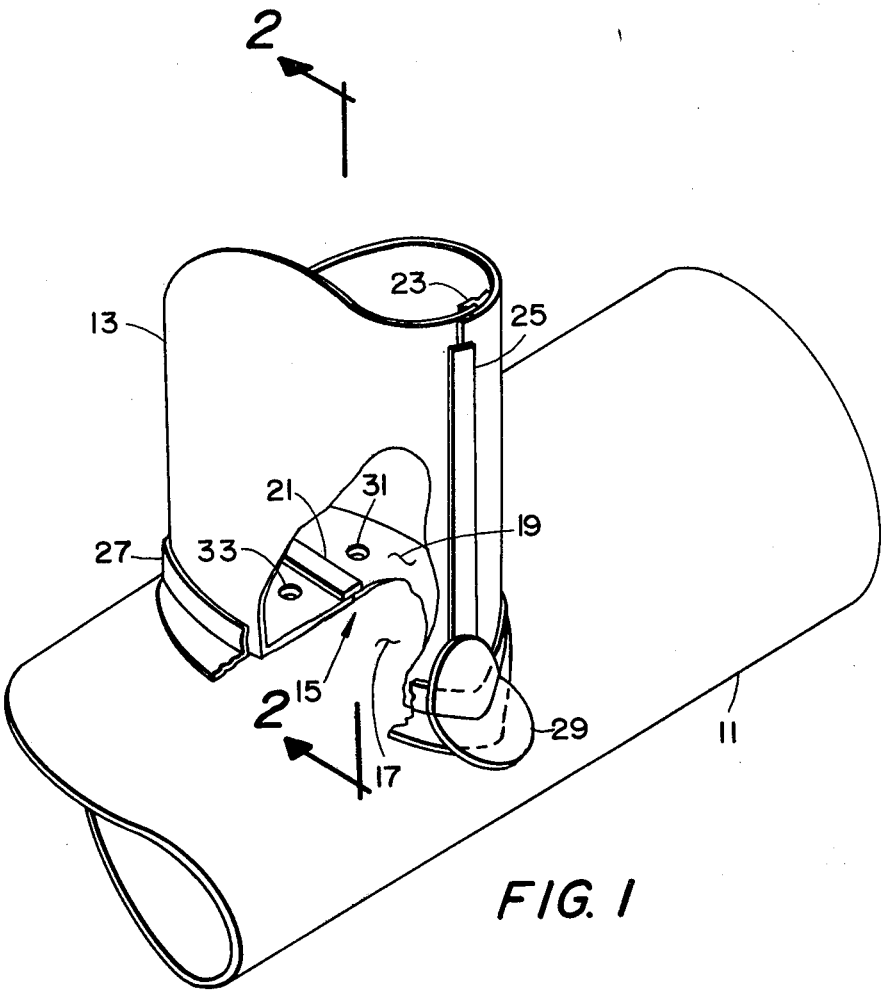
FIG. 1 is a perspective view of an inflatable raft construction showing the junction of an arch tube with a buoyancy tube in accordance with the invention.
Figure 2:
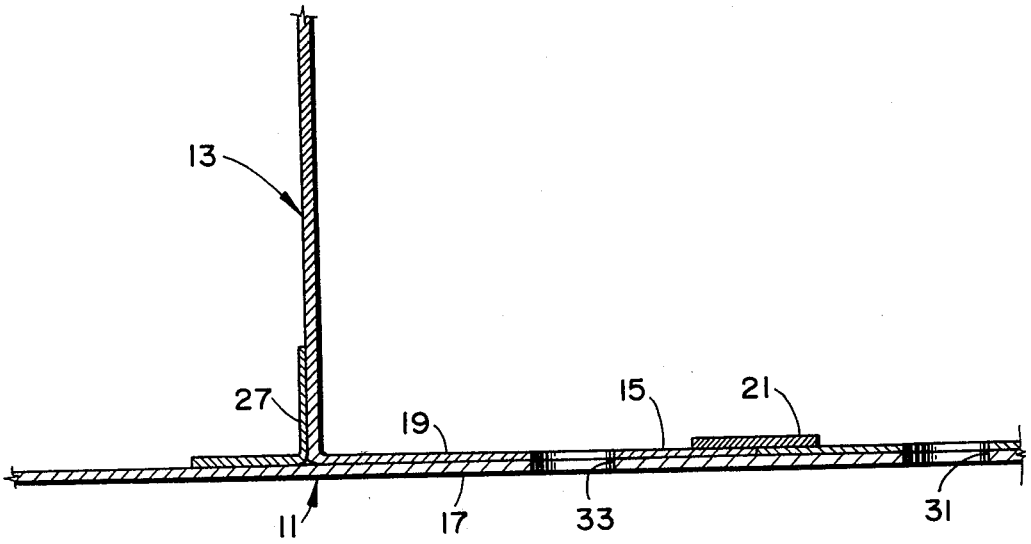
FIG. 2 is a sectional view along the lines 2—2 of FIG. 1.

Referring to FIGS. 1 and 2 there is partially shown a buoyancy tube 11 to which an arch tube 13 is attached. While the buoyancy tube serves as the name implies, to provide buoyancy to the raft itself the arch tube may be utilized to support a canopy over the raft to protect occupants from the elements.

Both the buoyancy tube 11 and the arch tube 13 are cylindrical in form such that the surface of their intersection is a cylindrical segment having, in a projection axial to the arch tube, a circular periphery. Such a bounded surface shall be referred to herein as a surface of cylindrical intersection. Referring still to FIGS. 1 and 2, the surface of cylindrical intersection 15 is defined by surfaces 17 of the buoyancy tube 11 and 19 which forms the end of the arch tube 13. The end of the arch tube 13 is cemented closed with the help of seam tape 21 and seam tapes 23 and 25 serve to complete the closure of the arch tube 13 as a cylinder. The surfaces 17 and 19 are cemented together across the entire surface of cylindrical intersection 15 and a flange tape 27 is cemented about the outside of that intersection for reinforcement. Reinforcement patch 29 is cemented across the longitudinal seam of the arch tube 13 at its junction with the buoyancy tube 11. A pair of gas passage openings 31 and 33 are provided through the surfaces 17 and 19 whereby inflating gases may pass between the buoyancy and the arch tube.

Figure 3:
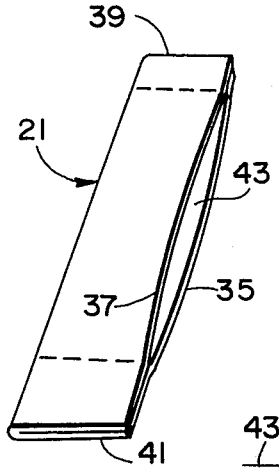
FIG. 3 is a perspective view of a hinge section used in accordance with the invention.
Figure 4:
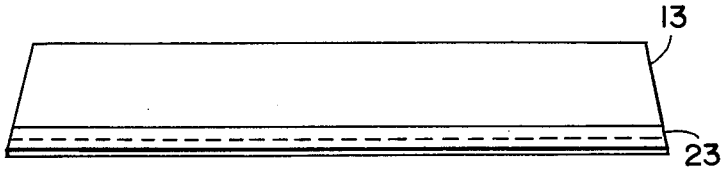
FIG. 4 is a perspective view of an arch tube in accordance with the invention shown in its flattened condition.
Figure 5:
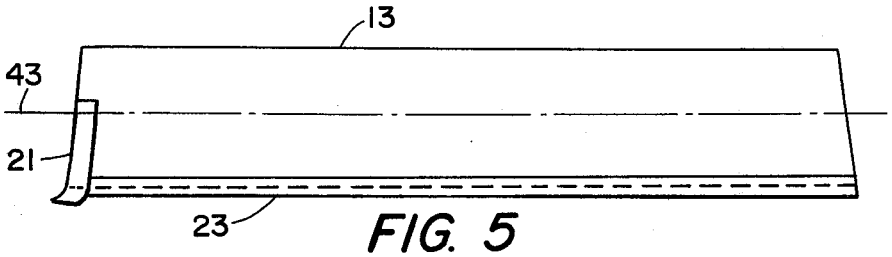
FIG. 5 is a view similar to FIG. 4 but showing the hinge section cemented to the arch tube.
Figure 6:
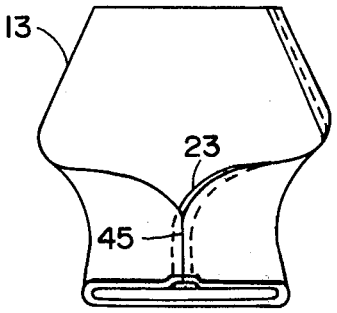
FIG. 6 is a perspective view showing the ends of the arch tube being partially formed as an open ended tube.
Figure 8:
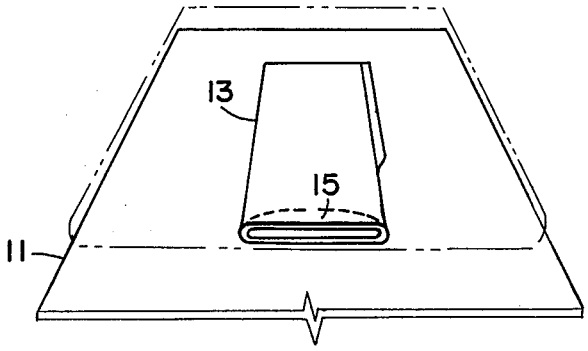
FIG. 8 is a perspective view showing the arch tube partially formed and overlying the flattened fabric of the buoyancy tube for cementing one side of the arch tube to the buoyancy tube.
Figure 9:
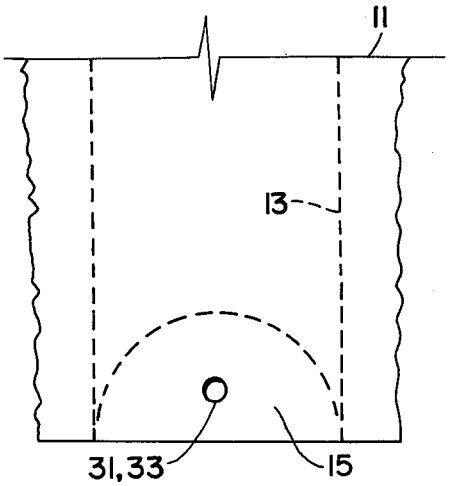
FIG. 9 is a partial top plan view showing the arch tube cemented within the fold of the buoyancy tube fabric and with vent holes punched therethrough.

Referring to FIGS. 3 through 9 the method of construction can be seen. FIG. 3 shows a seam tape 21 folded and formed as a hinge having leaves 35 and 37 the ends of which 39 and 41 are cemented together to provide a pocket 43. The arch tube 13 is formed of an elongated length of fabric 13' as shown in FIG. 4 and an inner seam tape 23 is cemented along one longitudinal edge thereof. Thereafter, as shown in FIG. 5, one outer surface of the hinged seam tape 21 is secured to one end margin of the fabric 13' positioned to extend slightly beyond the center line 43 thereof and one edge. Although not specifically shown in FIG. 5 the pocket 43 of the hinged shaped seam tape 21 has its opening directed away from the end of the fabric 13'. After one surface of the hinged seam tape 21 is secured, the fabric 13' is longitudinally folded upon itself as shown in FIG. 6 and at least a short portion of the longitudinal seam 45 is cemented together at that end to which the seam tape 21 is secured. (For clarity the hinged seam tape 21 is not shown in FIG. 6).

Figure 7:
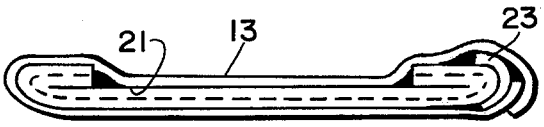
FIG. 7 is an end view of the arch tube shown with the hinge section cemented in place.

After the end of the seam 45 is cemented together that entire end of the arch tube 13 is completely sealed by cementing the other outer surface of the hinged section 21 (the upper side as shown in FIG. 7) to the remainder of the end margin of the arch tube 13. The next step is to lay the partially assembled arch tube 13 onto the surface of the buoyancy tube fabric 11', as shown in solid lines in FIG. 8. The end of the incomplete arch tube 13' is cemented to the fabric 11' across one-half of the surface of cylindrical intersection 15 after which the fabric 11' is folded back over the partially completed arch tube 13' to the position shown in phantom lines in FIG. 8. The incomplete arch tube 13' is then cemented to the buoyancy tube fabric over the remainder of the surface of cylindrical intersection. With the fabric 11' still in its folded position over the end of the arch tube 13', gas vents 31, 33 are punched through all four thicknesses of fabric.

The fabric 11' is thereafter unfolded and the hinged seam tape 21 opens over the surface of cylindrical intersection to a flat condition, as shown in FIG. 1. The buoyancy tube fabric 11' is formed into a tube by cementing a seam along its longitudinal edges. If the seam 45 of the arch tube has only been partially formed it is now completed. Outside seam tape 25, flange tape 27 and reinforcing patch 29 are secured by cement and the construction is complete.

It is therefore seen that a construction, as shown in FIG. 1 is provided whereby each of the individual tubes, the buoyancy tube 11 and the arch tube 13, maintain their integrety. The skin strength, particularly of the buoyancy tube 11, is maintained since it is not necessary to cut a large opening therein to insert and secure the arch tube. Moreover, the construction can be accomplished without the need of complicated jigs and clamps and an overall improved product is provided.

What is claimed is:

1. In a method of constructing an inflatable raft, the steps comprising forming a first flat sheet of fabric into at least a partially formed tube by cementing together the longitudinal edges of the fabric at one end thereof, sealing said one end of the tube, placing the partially formed tube on a second flat sheet of fabric, cementing the sealed end of the at least partially formed tube to said second flat sheet of fabric across one-half a surface of cylindrical intersection, folding said second flat sheet over the end of the partially formed tube and cementing the partially formed tube to the second sheet of fabric across the remainder of said surface of cylindrical intersection.

2. The method of constructing an inflatable raft as defined in claim 1 together with the step of punching vents through the fabric within said surface of cylindrical intersection after said second sheet of fabric is cemented to both sides of the partially formed tube.

3. The method of constructing an inflatable raft as defined in claim 1 together with the steps of folding a length of seam tape and cementing the ends together to form a hinge section, cementing one outer surface of the hinge section to a portion of one end margin of said first flat sheet of fabric prior to forming it into at least a partially formed tube and cementing the other outer surface of the hinge section to the remainder of said end margin after said first sheet of fabric is formed into at least a partially formed tube.

4. In a method of constructing an inflatable raft, the steps comprising folding a first length of seam tape longitudinally and cementing its ends together forming a pocket therebetween and thereby creating a hinge section, cementing a second length of seam tape along one longitudinal edge of a first flat sheet of fabric, cementing one outer surface of the hinge section to one end margin of said first flat sheet of fabric positioned to extend slightly beyond the center line of the fabric and one longitudinal edge and with the pocket of the hinge section opening away from said end of the fabric, forming said first flat sheet of fabric into at least a partially formed tube by cementing together the longitudinal edges of the fabric and said second length of seam tape at that end of the fabric to which the hinge section is cemented, cementing the other outer surface of the hinge section to the remainder of said end margin to thereby seal the end of the at least partially formed tube, placing the at least partially formed tube on a second flat sheet of fabric, cementing the sealed end of the partially formed tube to said second flat sheet of fabric across one half a surface of cylindrical intersection, folding said second flat sheet over the end of the partially formed tube, cementing the partially formed tube to the second sheet of fabric across the remainder of said surface of cylindrical intersection and punching vents through the fabric within said surface of cylindrical intersection.

5. In a method of constructing an inflatable raft, the steps comprising forming at least a partially formed tube, sealing one end of the tube, cementing the sealed end of the at least partially formed tube across one half a surface of cylindrical intersection on the surface of a fabric to be employed as a second tube, folding the second tube over the end of the partially formed tube and cementing the partially formed tube to the remainder of said surface of cylindrical intersection, and punching a vent through the two tubes within said surface of intersection.

6. An inflatable raft constructed by forming at least a partially formed tube, sealing one end of the tube, cementing the sealed end of the at least partially formed tube across one half a surface of cylindrical intersection on the surface of a fabric to be employed as a second tube, folding the second tube over the end of the partially formed tube and cementing the partially formed tube to the remainder of said surface of cylindrical intersection, and punching a vent through the two tubes within said surface of intersection.

* * * * *